US011503882B1

(12) United States Patent
Pringle

(10) Patent No.: US 11,503,882 B1
(45) Date of Patent: Nov. 22, 2022

(54) BIKE CLEAT FITTING TOOL SYSTEM AND METHODS OF USE

(71) Applicant: Bike Energy Lab Ltd., Discovery Bay (HK)

(72) Inventor: Antony Pringle, Discovery Bay (HK)

(73) Assignee: Bike Energy Lab Ltd., Hong Kong (HK)

( * ) Notice: Subject to any disclaimer, the term of this patent is extended or adjusted under 35 U.S.C. 154(b) by 0 days.

(21) Appl. No.: 17/742,958

(22) Filed: May 12, 2022

Related U.S. Application Data

(60) Provisional application No. 63/252,075, filed on Oct. 4, 2021.

(51) Int. Cl.
*A43D 1/02* (2006.01)
*A43D 1/08* (2006.01)
*A43B 5/14* (2006.01)

(52) U.S. Cl.
CPC ..... *A43D 1/027* (2013.01); *A43B 5/14* (2013.01); *A43D 1/08* (2013.01)

(58) Field of Classification Search
CPC ... A43B 5/14; A43D 1/08; A43D 1/02; A43D 1/027
See application file for complete search history.

(56) References Cited

U.S. PATENT DOCUMENTS 3,579,837 A * 5/1971 Soriano ..... A43D 1/02 33/3 B
3,854,212 A * 12/1974 Rose ..... A43D 1/02 33/3 A
5,101,568 A * 4/1992 Ferragamo ..... A43D 1/02 33/3 B
5,946,754 A * 9/1999 Baldini ..... A43B 5/14 12/123
6,293,169 B1 9/2001 Takahama
9,307,805 B2 * 4/2016 Tanaka ..... A43D 100/00
(Continued)

FOREIGN PATENT DOCUMENTS

CN 101801780 A 8/2010
DE 102013101076 A1 12/2013
(Continued)

OTHER PUBLICATIONS

Cleat Fit—Selle Italia, available at least as early as Sep. 21, 2021 at https://www.selleitalia.com/en/idmatch/cleat-fit/.
(Continued)

*Primary Examiner* — Megan E Lynch
(74) *Attorney, Agent, or Firm* — Dentons Durham Jones Pinegar; Sarah W. Matthews

(57) ABSTRACT

A bicycle cleat-fitting tool system may include a body with a superior face and an inferior face. The body defines a cleat receptacle for receiving a cleat to be fitted, with the cleat receptacle perpendicular to a medial line of the body. The superior face of the body includes a cleat retaining mechanism to selectively hold a cleat to be fitted in place within the cleat receptacle. The body also includes angle measurement indicia to indicate a degree of rotation of the body and the cleat receptacle with respect to a bicycle shoe to be fitted with the cleat. Methods for determining an accurate toe-out angle and angle of adjustment for the cleat are also described.

17 Claims, 9 Drawing Sheets

(56) References Cited

U.S. PATENT DOCUMENTS

| | | | | |
|---|---|---|---|---|
| 9,675,139 | B2 * | 6/2017 | Shelley | A43D 5/00 |
| 2007/0084086 | A1 | 4/2007 | Bryne | |
| 2008/0110294 | A1 | 5/2008 | Bryne | |
| 2008/0184572 | A1 * | 8/2008 | Hay | A43D 1/02 33/3 B |
| 2009/0126210 | A1 * | 5/2009 | Ball | A43D 1/02 33/3 B |
| 2010/0307030 | A1 | 12/2010 | Tafaute et al. | |
| 2013/0167391 | A1 * | 7/2013 | Pratinidhi | A61B 5/1074 33/512 |
| 2013/0318763 | A1 | 12/2013 | Aoki et al. | |
| 2013/0318805 | A1 * | 12/2013 | Aoki | B62M 3/086 33/515 |
| 2013/0333124 | A1 * | 12/2013 | Okamoto | A43D 5/02 12/123 |
| 2014/0026334 | A1 | 1/2014 | Shelley | |
| 2014/0182152 | A1 * | 7/2014 | Towns | A43D 1/025 33/515 |
| 2014/0317956 | A1 * | 10/2014 | Tanaka | A43D 100/00 36/62 |
| 2016/0309847 | A1 * | 10/2016 | Le Goallec | A43C 15/161 |

FOREIGN PATENT DOCUMENTS

| | | | |
|---|---|---|---|
| DE | 102013203112 | B4 | 5/2017 |
| JP | 2020508820 | A | 3/2020 |
| WO | 2005025974 | A1 | 3/2005 |

OTHER PUBLICATIONS

Cleat Position Tool, available at least as early as Sep. 21, 2021 at http://www.customshop4.us/cleat-position-tool-c2x16577646?PGFLngID=1.

CleatVelo, available at least as early as Sep. 21, 2021 at https://velosystem.com/tecnico/cleatvelo/?lang=en.

Clet Rak, available at least as early as Sep. 21, 2021 at https://www kickstarter.com/projects/1220674079/clet-rak-a-tooling-machine-for-the-cyclist-indeed?ref=discovery&term=bike%20cleat%20tool.

Ergon TP1, available at least as early as Sep. 21, 2021 at https://www.ergonbike.com/en/product.html?a=bikefitting.

Fit4bike, available at least as early as Sep. 21, 2021 at https://www.youtube.com/watch?v=CCPLU8vw2nc.

ML Cleat—MorphoLogics, available at least as early as Sep. 21, 2021 at http://www.morpho-logics.com/en/mesurement-tools/1-ml-cleat.html.

Rad, available at least as early as Sep. 21, 2021 at https://www.daisyway.co.za/fit-your-bike/rad/.

Shimano, available at least as early as Sep. 21, 2021 at https://cyclelane.cc/products/shimano-tl-sh11-spd-cleat-setting-tool.

Shoe Cleat Adjustment Tool, available at least as early as Sep. 21, 2021 at https://www.bikefitting.com/en/our-services.

National Science and Technology Search Unit, "Chinese Search Report," U.S. Appl. No. 17/742,958, dated Jul. 4, 2022.

* cited by examiner

BIKE CLEAT FITTING TOOL SYSTEM AND METHODS OF USE

PRIORITY CLAIM

This application claims priority to U.S. provisional application No. 63/252,075 filed Oct. 4, 2021, which is hereby incorporated herein in its entirety.

TECHNICAL FIELD

The present disclosure relates generally to devices to assist attachment between shoes and pedals, e.g. cleats. More specifically, and without limitation, the present disclosure relates to a tool system and methods of use to ensure accurate angular, lateral, and fore-aft positioning of a cleat onto a cycling shoe.

RELATED ART

Many bicycle riders wear bicycle shoes that include a cleat attachable to the bicycle shoe. The bicycle pedals provide a coupling device for the cleat to snap in to the pedal. This cleat/pedal combination allows the rider push down and also pull up without their foot in the shoe coming off the pedal. To remove the shoe from the pedal, the rider twists the cleat of the shoe out of the pedal coupling device. Twisting out releases the cleat from the pedal (twisting out may be necessary, for example, if the rider needs to jump off the bicycle in the event of a crash).

Cleat installation is perhaps the most critical aspect of bike fitting. It is critical to both the rider's comfort and the efficient power transfer. Various cleat fitting devices have been developed to assist users in accurately placing cleats on cycling shoes. However, most devices are very complex to use and require special training and/or certification by a professional bike fitter. These devices are also often prohibitively expensive.

There is a need for a simple method and apparatus that permits simple and accurate fitting of a cleat onto a bicycle, and accounts for angular positioning of the cleat. There is also a need for a device that can be used by both serious bicyclists and hobbyists, which is inexpensive, may be used by the user without the need of a professional evaluation, and may be used for a variety of types of cleats and cycling shoes.

SUMMARY

According to one aspect, a bicycle cleat-fitting tool system may comprise: a body having a superior face and an inferior face, a front portion and a back portion; the body defining a cleat receptacle for receiving a cleat to be fitted, the cleat receptacle perpendicular to a medial line of the body; the superior face of the body comprising a cleat retaining mechanism to selectively hold a cleat to be fitted in place within the cleat receptacle; and the superior face of the body comprising angle measurement indicia to indicate a degree of rotation of the body and the cleat receptacle with respect to a bicycle shoe to be fitted with the cleat.

According to one aspect, the body is formed of transparent material.

According to another aspect, the cleat retaining mechanism comprises an elongate lateral bar attached to the superior face of the tool via a spring, the spring biasing the lateral bar toward the front portion of the tool, the lateral bar movable over the cleat receptacle to hold a cleat in place within the cleat receptacle.

In some configurations, the lateral bar further comprises an indicia at a middle of the lateral bar to be aligned with an indicia at a middle of the cleat. The cleat receptacle may extend from the superior face to the inferior face.

According to another aspect, a bicycle cleat-fitting tool system may comprise: a body having a superior face and an inferior face, a front portion and a back portion; the body formed of transparent material, the body defining a void extending from the superior face to the inferior face, the void for receiving a cleat to be fitted, the void perpendicular to a medial line of the body extending from the front portion to the back portion of the body; the superior face of the body comprising a cleat attachment mechanism, the cleat attachment mechanism comprising a lateral bar attached to the superior face of the tool via a spring, the spring biasing the lateral bar toward the front portion of the tool, the lateral bar movable over the void to hold a cleat within the void in place within the void, and the lateral bar further comprising an indicia at a middle of the lateral bar; and the superior face of the body comprising angle measurement indicia to indicate a degree of rotation of the body with respect to a bicycle shoe to be fitted with the cleat.

According to another aspect, a method of fitting a cleat to a bicycle shoe, the method comprising: selecting the bicycle cleat-fitting tool system of claim 1; retracting the cleat retaining mechanism; fitting the cleat within the cleat receptacle and securing the cleat with the cleat retaining mechanism; aligning a center of the cleat receptacle with a marking indicating the center of the cleat; and rotating the body of the tool such that the angle measurement indicia indicate a predetermined cleat angle with respect to a marking indicating the center of a back of the bicycle shoe.

Other aspects of the disclosed subject matter, as well as features and advantages of various aspects of the disclosed subject matter, should be apparent to those of ordinary skill in the art through consideration of the ensuing description, the accompanying drawings, and the appended claims.

BRIEF DESCRIPTION OF DRAWINGS

The configurations set forth in the drawings are illustrative and exemplary in nature and not intended to limit the subject matter defined by the claims. The following detailed description of the illustrative embodiments can be better understood when read in conjunction with the following drawings wherein like structure is indicated with like reference numerals and in which:

DETAILED DESCRIPTION

Figure 1:
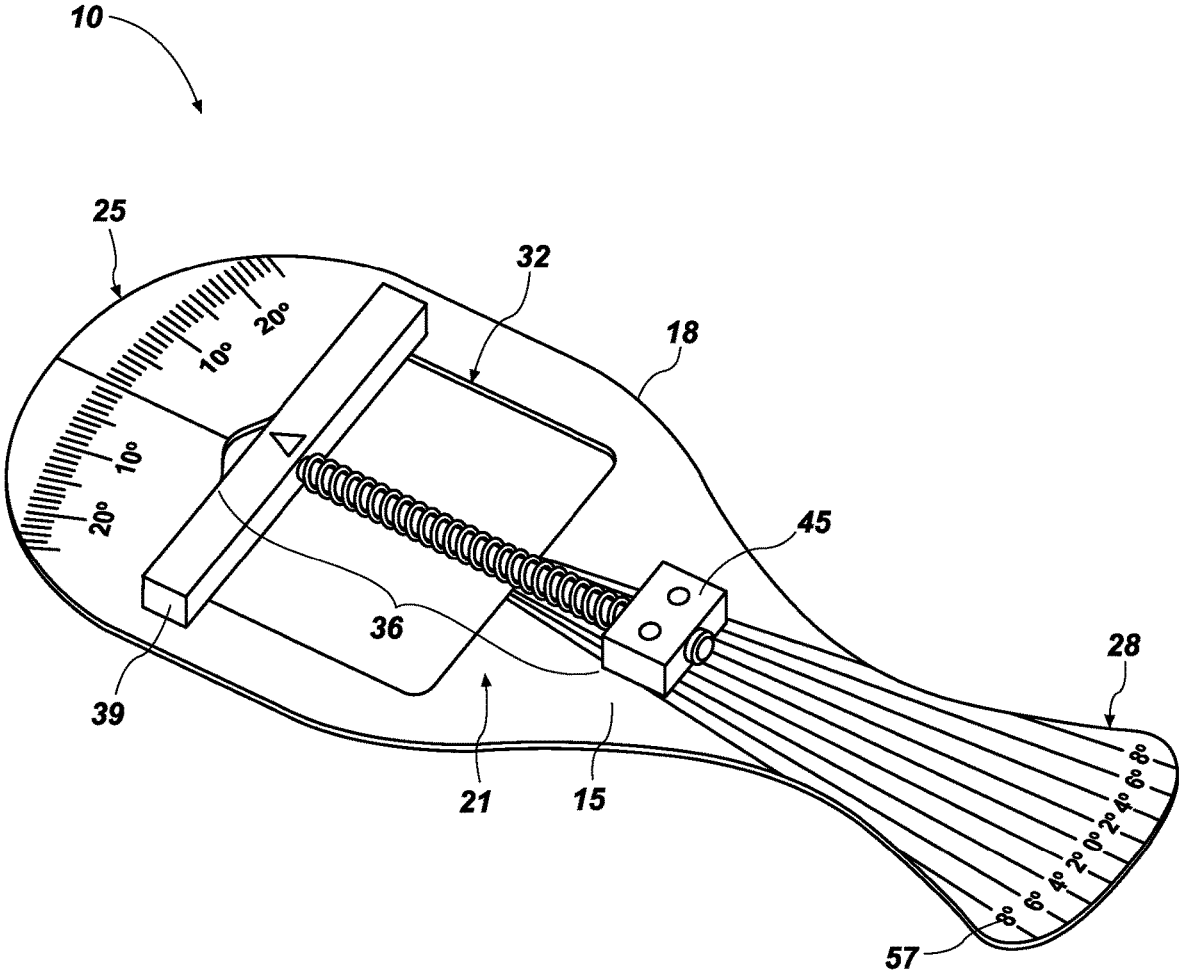
FIG. 1 is a perspective view of an exemplary cleat fitting device system.
Figure 2:
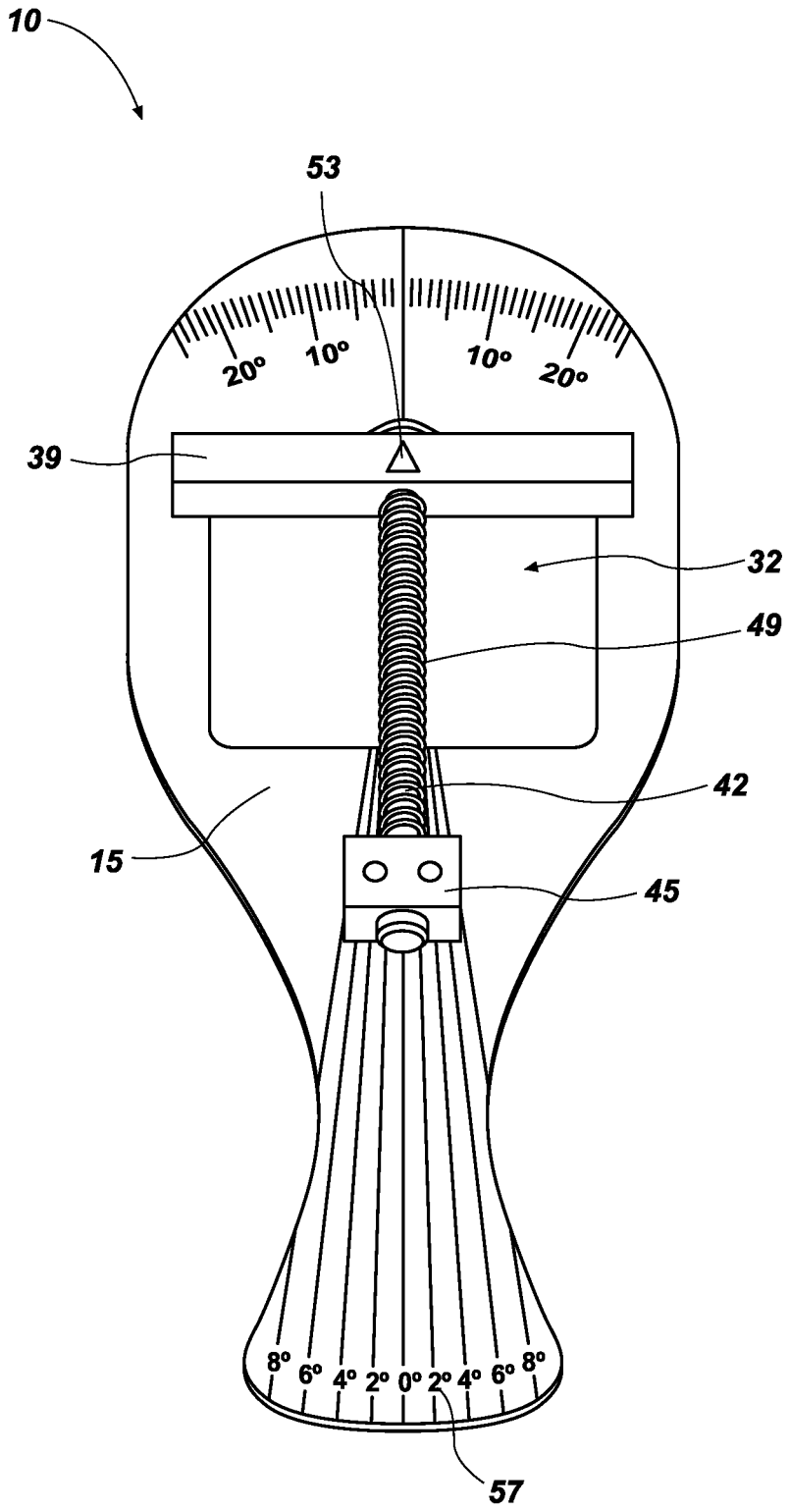
FIG. 2 is a perspective view of the cleat-fitting device of FIG. 1 taken from the back portion looking towards the front portion.
Figure 3:
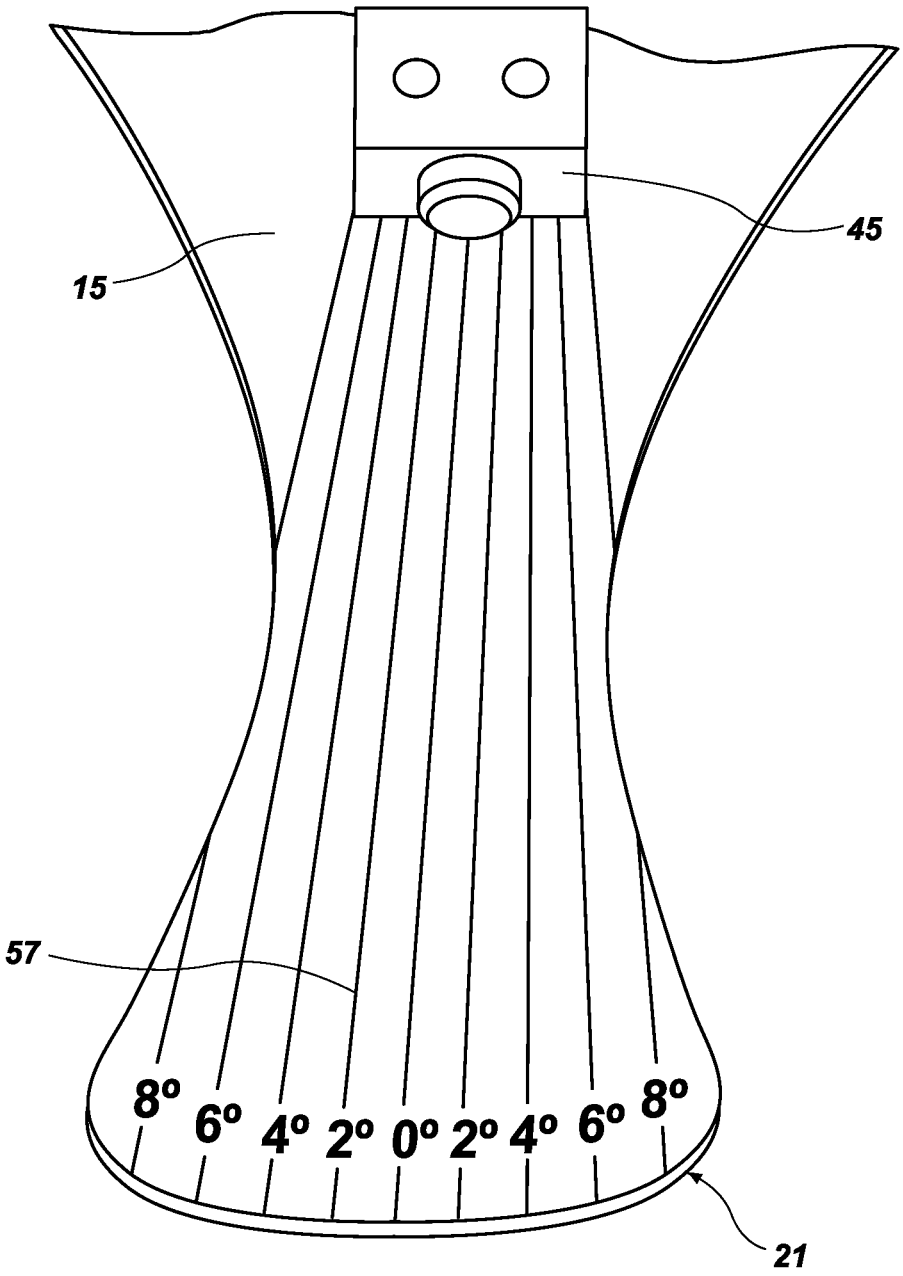
FIG. 3 is a perspective, detailed view of the back portion of the device shown in FIG. 2.

Hereinafter, exemplary embodiments of the present disclosure will be described in detail with reference to the accompanying drawings. Advantages and features of the present disclosure and methods accomplishing them will become apparent from the following description of exemplary embodiments with reference to the accompanying drawings. Various aspects discussed in reference to one drawing may be present and/or used in conjunction with the embodiment shown in another drawing, and each element shown in multiple drawings may be discussed only once.

This disclosure generally relates to devices and methods of fitting a cleat onto a cycling shoe. Proper fit of a cleat generally involves three separate positioning steps: (1) fore-aft positioning, (2) lateral (left-right) positioning, and (3) angle positioning. Fore-aft positioning and lateral positioning are typically easier than angle positioning of the cleat, as they rely on indicators that are easier to measure, such as the location of the cyclist's metatarsals within the cycling shoe. However, angle positioning of the cleat can be much more difficult and even professional fitters do not have a simple, accurate, and replicable way to ensure proper angle fit of a cleat.

FIGS. 1-4 show various perspective views of an exemplary bicycle cleat-fitting tool system 10 as disclosed herein. The tool system 10 may generally include a body 15. The body 15 may have a superior face 18, and an inferior face 21. As described in more detail below with respect to the method of use of the tool system 10, the inferior face 21 may be the face of the body 15 that typically faces the bottom of a cyclist's shoe when the tool system 10 is being used to place a cleat. The superior face 18 may be the face of the body that typically faces outwardly away from the shoe when the tool system 10 is being used to place a cleat. The body 15 also generally includes a front portion 25 and a back portion 28, with an imaginary medial or longitudinal line passing through the body from the front to the back. In some configurations, the front portion 25 includes optional angle markings 27 for use as a protractor as described in more detail below.

The body 15 may define a void or cleat receptacle 32 extending from the superior face 18 to the inferior face 21. The cleat receptacle or cleat receptacle 32 may be any suitable shape and size, and in the exemplary configurations shown, the cleat receptacle 32 may be generally rectangular and sized to receive a cleat. In other configurations, the cleat receptacle 32 may have different shapes and sizes to accommodate various shapes and sizes of cleats. The cleat receptacle 32 may be generally perpendicular to the medial line of the body, such that a cleat placed within the cleat receptacle 32 is held perpendicular to a medial or longitudinal line of the body 15. This may ensure accurate angular placement of the cleat with respect to the cycling shoe, as detailed below.

The superior face 18 of the body 15 is configured to be facing away from the cycling shoe, towards a user when the tool system 10 is in use to fit a cleat onto a shoe. The superior face 18 may further comprise a cleat attachment mechanism 36 or cleat retaining mechanism for selectively retaining a cleat within the cleat receptacle 32. The cleat retaining mechanism 36 may be any suitable mechanism to clamp, bias, or hold a cleat within the cleat receptacle 32.

Figure 4:
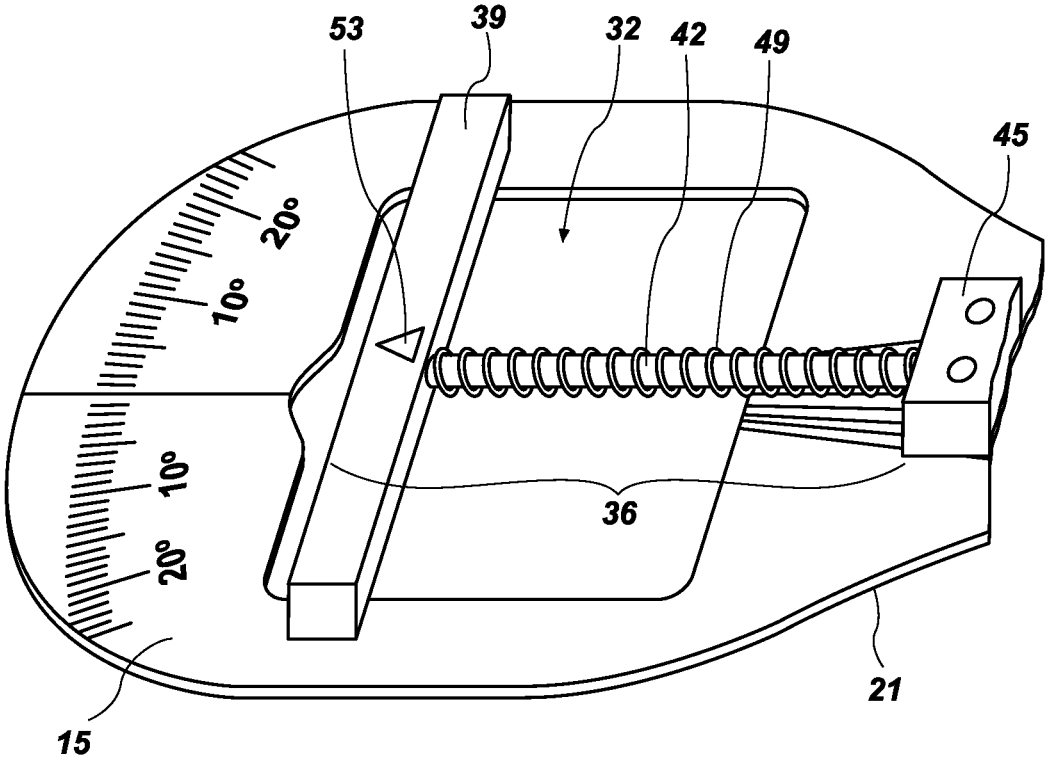
FIG. 4 is a perspective, detailed view of the front portion of the device shown in FIG. 1.

In one exemplary configuration, shown by way of example and not limitation, the cleat retaining mechanism 36 comprises a spring-loaded rod 42 mounted to the superior face 18 of the body 15, with an elongate lateral bar 39 attached to the forward-most end of the rod 42. In other configurations, the lateral bar 39 may be attached to the superior face 18 via other suitable biasing mechanisms. The spring-loaded rod 42 may be mounted to the superior face 18 via a base 45 that includes an aperture for receiving the rod 42. The spring 49 may be placed over the rod 42 between the base 45 and the lateral bar 39 (FIG. 4). The rod 42 may be selectively movable within the base 45, such that pressing rearwardly on the lateral bar 39 causes the rod 42 to also move rearwardly against the bias of the spring 49. When the rearward pressure on the lateral bar 39 is removed, the spring returns 49 the lateral bar 39 back to place towards the front portion of the body 15. The lateral bar 39 may be bias into a resting position over the cleat receptacle 32.

In some configurations, the lateral bar 39 of the cleat retaining mechanism 36 may comprise an indicia 53 at the middle of the lateral bar 39. This indicia 53 may allow a user to ensure that the center of the cleat retaining mechanism 36 is in line with the center of the cleat to be fitted. In other configurations wherein the cleat retaining mechanism 36 does not include a lateral bar 39, indicia 53 at the middle of the cleat retaining mechanism 36 may be provided. Or the indicia 53 may be provided proximal to a middle of the cleat receptacle 32, such as immediately below the cleat receptacle 32, at a lateral middle of the cleat receptacle 32. In yet other configurations, no indicia may be provided on the cleat retaining mechanism or proximal to the cleat receptacle.

In configurations with a cleat retaining mechanism 36 that comprise a spring-loaded lateral bar 39 and indicia 53 indicating the middle of the cleat retaining mechanism, the cleat retaining mechanism 36 acts as a self-centering clamp to ensure accurate placement of the cleat within the cleat receptacle 32 (and therefore accurate placement of the cleat on the cycling shoe). The spring-loaded lateral bar 39 ensures the cleat has very little (if any) play or movement longitudinally within the cleat receptacle 32. And the indicia 53 ensures the cleat is centered laterally within the cleat receptacle 32.

As seen in FIGS. 1-4, the superior face 18 of the body 15 may comprise angle measurement indicia 57 to indicate a degree of rotation of the body 15 with respect to a bicycle shoe to be fitted with the cleat. In other configurations, the angle measurement indicia 57 may be provided on the inferior face 21. This may be true especially in configurations were the body 15 is formed of transparent material. Whether the angle measurement indicia 57 are provided on the superior face 18 or the inferior face 21, the angle measurement indicia may be printed, stamped, embossed, etc., such that they may be read from a user looking at the superior face. For angle measurement indicia 57 on the inferior face, it may be printed, stamped, embossed, etc., backward so that it may be read from the superior face 18. The angle measurement indicia 57 may extend from the rearward end of the cleat receptacle 32, to the back portion 28 of the body 15. This may make the tool simpler to use and allow for easier reading of the angle on the body 15 of the tool. In other configurations, the angle measurement indicia 57 may not extend the full length from the rearward end of the cleat receptacle 32 to the rearward end of the body 15, but may extend only part of the length.

The body 15 may be formed of any suitable material and by any suitable means. In some configurations, the body 15 may be formed of transparent material. For example, the body 15 may be formed of transparent polycarbonate plastic plate with stenciling for the angle measurement indicia 57 and a cut-out for cleat receptacle 32. Other suitable transparent materials may also be used to form the body 15. Transparent material may allow the tool system to be more user friendly, as the user can see the shoe and the cleat to be fitted to the shoe through the body 15 during the adjustment and attachment process. In other configurations, the body 15 may be formed of non-transparent materials.

Figure 10:
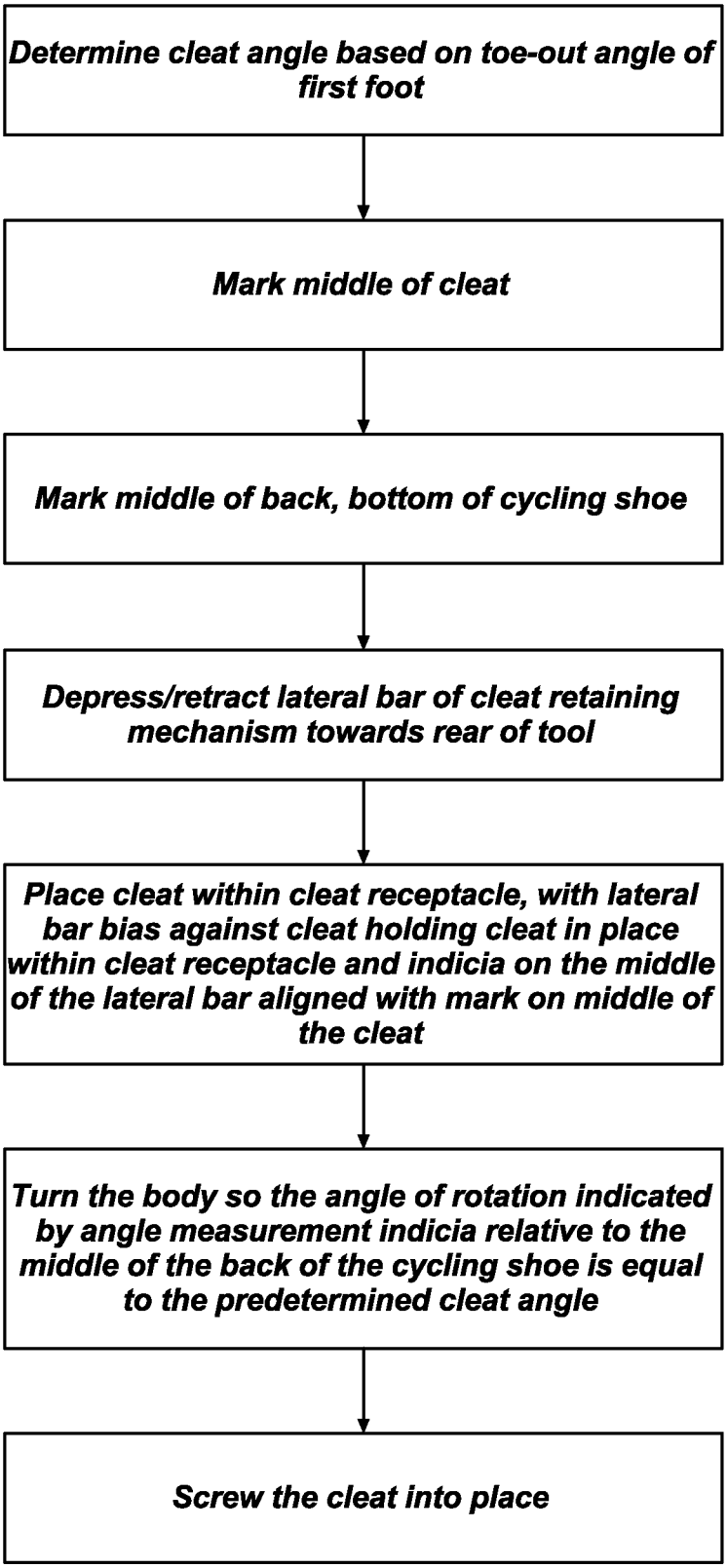
FIG. 10 shows a flowchart of steps that may be used according to an exemplary method of fitting a cleat onto a bicycle shoe.

In use, a user may first determine their fore-aft positioning and lateral (left-right) positioning by methods known in the art, such as the position of the user's metatarsals and the width of the user's hips. With reference to FIG. 10, a user may then measure the rotation angle, or "toe-out" angle of each of their feet (this may be a different angle for a user's right foot and left foot). It will be appreciated that while the steps described herein and in FIG. 10 are shown as discrete steps occurring in a particular order, the order of the steps may be varied, and one or more steps may be performed at the same time.

Figure 5:
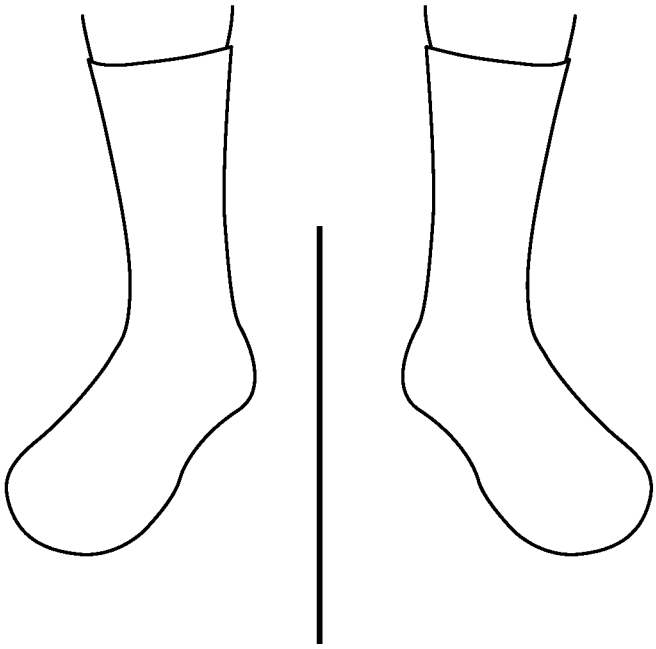
FIGS. 5-7 show a method of measuring a user's angle-out position of their feet.
Figure 6:
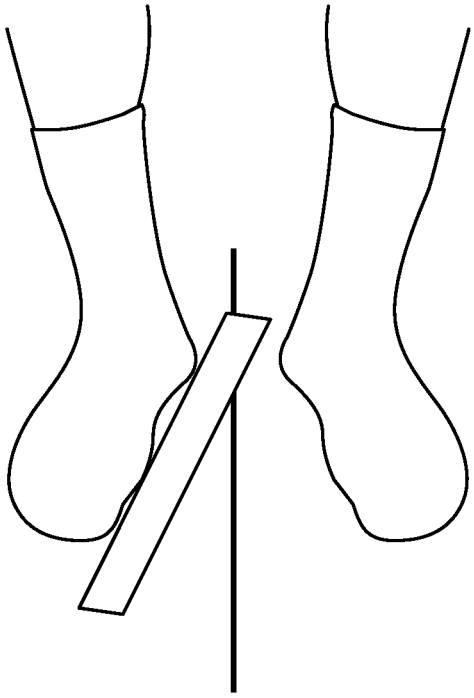
Figure 7:
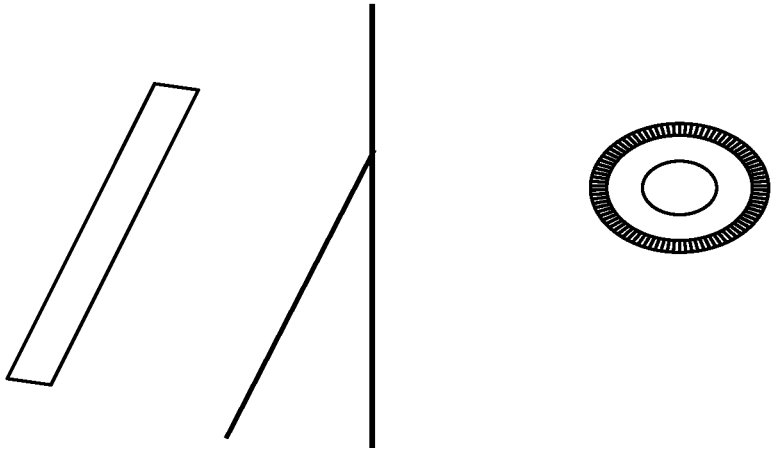

Determining the user's rotation angle, or "toe-out" angle may be done by, for example, by performing a jump test. With reference to FIGS. 5-7, first, a straight line 51 may be drawn on the ground. The user may place one foot on either side of the straight line, and then jump up and down and slowly land on their heels. The user can also walk forwards and backwards to determine the "toe-out" angle of their feet. Users vary in the natural angle of their feet, and also may vary between their feet. For example, a user may tend to walk with one foot having the toe angled out more than the other foot. Fitting the bike cleat to consider this natural position will result in a more comfortable riding experience and more efficient power transfer. In other configurations, the predetermined cleat angle may be determined by other types of tests besides a jump test. For example, other methods for determining a user's rotation angle, also known as a "toe-out" angle or foot splay, may also be known in the art and used with the system described herein. It will be appreciated that the system described herein may be used to set any predetermined cleat angle, without respect to how the cleat angle is determined.

The user can determine their rotation angle, or "toe-out" angle 55 as measured with a protractor 59 (FIG. 7). Or in other configurations, the user can use the angle markings 27 located on the front portion 25 of the tool system 10 as a protractor to measure the "toe-out" angle 55. This angle 55 may be adjusted by a predetermined factor to determine the preferred cleat position angle, or a predetermined cleat angle. For example, in one configuration, the measured "toe-out" angle may be divided by three to determine the predetermined cleat angle. In other configurations, the measured "toe-out" angle may be adjusted and/or divided (or not divided) by another number to determine the most accurate cleat angle for the individual cyclist.

The user may then make appropriate reference markings on the bicycle shoe and/or the cleat to be fitted to the shoe. For example, the user may make a marking that indicates the middle of the back of the cycling shoe. This marking may be used as a reference for a 0 degree rotation of the cleat. To ensure accurate placement of the marking indicating the middle of the back of the cycling shoe, Another marking may be made indicating the center of the cleat to ensure the cleat is rotated from the center of the cleat to achieve the correct angle.

Figure 8:
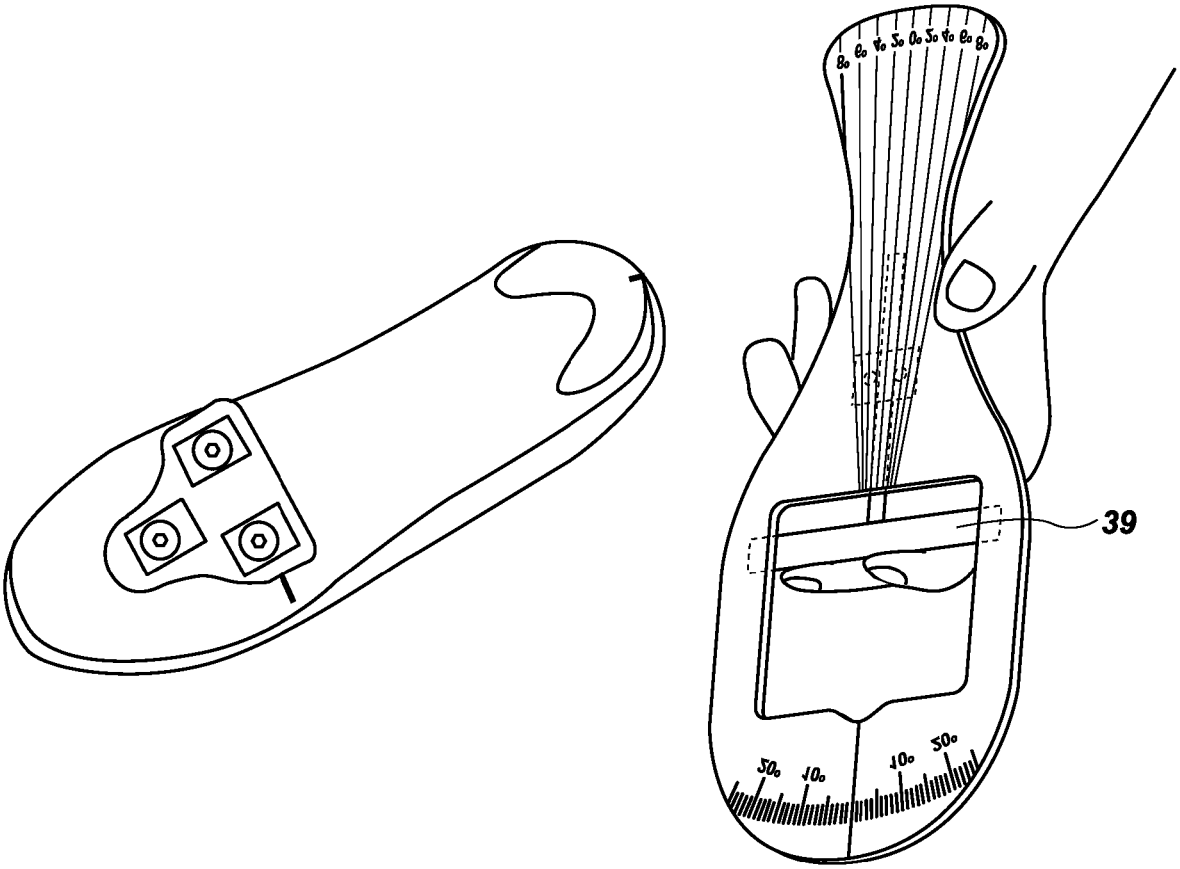
FIG. 8 shows a perspective view of the cleat-fitting device system of FIG. 1, with a user preparing to place the device system onto a cycling shoe.
Figure 9:
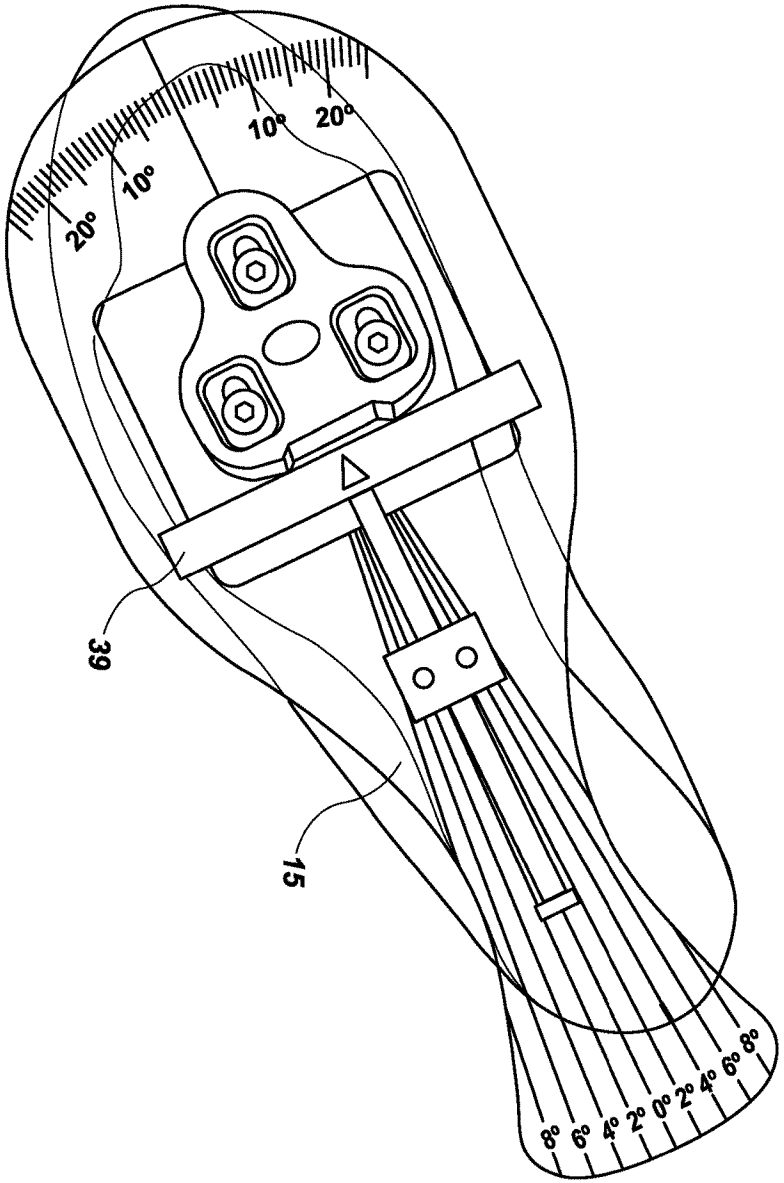
FIG. 9 shows a perspective view of the cleat-fitting device system of FIG. 1 in place on a cycling shoe.

After the appropriate reference markings are made and the user knows the desired cleat angle (either by performing jump tests or using another method), the user may then attach the tool system 10 to the cycling shoe with the cleat to be fitted. This may be done by first pressing rearwardly on the lateral bar 39 (FIG. 8) to move the lateral bar against the spring and towards the rear of the body 15 of the tool system. The cleat may be inserted into the cleat receptacle 32, and the lateral bar 39 may be released. The lateral bar 39 may continue to be biased towards the front portion 25, holding or clamping the cleat in place within the cleat receptacle 32 (FIG. 9).

The user may then align the marking made on the center of the cleat with the indicia 53 provided on the lateral bar 39 of the cleat retaining mechanism 36. Once the cleat is in place and aligned in the middle of the cleat receptacle, the user may then adjust the cleat to the appropriate angle. This is done with reference to the marking made at the middle of the back of the cycling shoe. This marking is taken as 0 degrees of rotation. The user may rotate the tool such that the predetermined cleat angle aligns with the marking at the middle of the back of the cycling shoe. The user may also check to ensure at this time that the position of the cleat also aligns with the fore-aft positioning and lateral positioning already determined. With the cleat angle determined and the fore-aft positioning and lateral positioning checked, the user may then permanently affix the cleat into place on the cycling shoe. The tool system 10 may then be removed from the shoe. These steps may be repeated for the user's other foot and shoe, as the cleat angle can vary between a user's feet.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. In some embodiments, the terms "about" and "approximately" refer to numerical parameters within 10% of the indicated range.

The terms "a," "an," "the," and similar referents used in the context of describing the embodiments of the present disclosure (especially in the context of any claimed invention) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Reference in the specification to "one configuration," "one embodiment," "a configuration," or "an embodiment" means that a particular feature, structure, or characteristic described in connection with the configuration is included in at least one configuration, but it is not a requirement that such feature, structure, or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims. The described features, structures, or characteristics of configurations of the disclosed subject matter may be combined in any suitable manner in one or more configurations. As used in this specification and the appended claims, singular forms such as "a," "an," and "the" may include the plural unless the context clearly dictates otherwise. Thus, for example, reference to "a spring" may include one or more of such springs and reference to "the cleat" may include reference to one or more of such cleats. Structural elements, compositional elements, and/or materials may be presented in a common list for convenience. However, these lists should be construed as though each member of the list is individually identified as a separate and unique member.

Certain embodiments are described herein, including the best mode known to the author(s) of this disclosure for carrying out the disclosed embodiments. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Herein throughout, "elongate" is intended to mean having a greater length than width or, in other words, a greater longitudinal extent than a lateral extent. Embodiments of this disclosure so claimed are inherently or expressly described and enabled herein.

Aspects disclosed here:

Aspect 1: A bicycle cleat-fitting tool system comprising:

a body having a superior face and an inferior face, a front portion and a back portion;

the body defining a cleat receptacle for receiving a cleat to be fitted, the cleat receptacle perpendicular to a medial line of the body;

the superior face of the body comprising a cleat retaining mechanism to selectively hold a cleat to be fitted in place within the cleat receptacle; and the superior face of the body comprising angle measurement indicia to indicate a degree of rotation of the body and the cleat receptacle with respect to a bicycle shoe to be fitted with the cleat.

Aspect 2: The bicycle cleat-fitting tool system of Aspect 1, wherein the body is formed of transparent material.

Aspect 3: The bicycle cleat-fitting tool system of Aspect 1 or 2, wherein the cleat retaining mechanism comprises an elongate lateral bar attached to the superior face of the tool via a spring, the spring biasing the lateral bar toward the front portion of the tool, the lateral bar movable over the cleat receptacle to hold a cleat in place within the cleat receptacle.

Aspect 4: The bicycle cleat-fitting tool system of Aspect 3, the lateral bar further comprising an indicia at a middle of the lateral bar to be aligned with an indicia at a middle of the cleat.

Aspect 5: The bicycle cleat-fitting tool system of Aspect 3, wherein the cleat receptacle extends from the superior face to the inferior face.

Aspect 6: The bicycle cleat-fitting tool system of any of Aspects 1, 2, 3, 4, or 5, wherein the front portion of the body further comprises angle measurement indicia.

Aspect 7: A bicycle cleat-fitting tool system comprising:

a body having a superior face and an inferior face, a front portion and a back portion;

the body formed of transparent material, the body defining a void extending from the superior face to the inferior face, the void for receiving a cleat to be fitted, the void perpendicular to a medial line of the body extending from the front portion to the back portion of the body;

the superior face of the body comprising a cleat attachment mechanism, the cleat attachment mechanism comprising a lateral bar attached to the superior face of the tool via a spring, the spring biasing the lateral bar toward the front portion of the tool, the lateral bar movable over the void to hold a cleat within the void in place within the void, and the lateral bar further comprising an indicia at a middle of the lateral bar; and the superior face of the body comprising angle measurement indicia to indicate a degree of rotation of the body with respect to a bicycle shoe to be fitted with the cleat.

Aspect 8: The bicycle cleat-fitting tool system of Aspect 7, wherein the front portion of the body further comprises angle measurement indicia.

Aspect 9: A method of fitting a cleat to a bicycle shoe, the method comprising:

selecting the bicycle cleat-fitting tool system of claim 1;

retracting the cleat retaining mechanism;

fitting the cleat within the cleat receptacle and securing the cleat with the cleat retaining mechanism;

aligning a center of the cleat receptacle with a marking indicating the center of the cleat; and rotating the body of the tool such that the angle measurement indicia indicate a predetermined cleat angle with respect to a marking indicating the center of a back of the bicycle shoe.

Aspect 10: The method of Aspect 9, wherein the method further comprises the step of measuring a user's right foot rotation angle and the user's left foot rotation angle.

Aspect 11: The method of Aspect 9 or 10, wherein the step of measuring the user's right foot rotation angle and the user's left foot rotation angle comprises instructing the user to place their right foot on one side of a straight line, and their left foot on the other side of the straight line, and further instruct the user to jump and/or walk forwards and backwards.

Aspect 12: The method of Aspect 9, 10 or 11, wherein the method further comprises determining a user's predetermined cleat angle for the user's right foot by dividing the user's right foot rotation angle by three, and determining a user's predetermined cleat angle for the user's left foot by dividing the user's left foot rotation angle by three.

Aspect 13: The method of Aspect 9, 10, 11, or 12, wherein the method further comprises determining a user's predetermined cleat angle for the user's right foot by dividing the user's right foot rotation angle by three, and determining a user's predetermined cleat angle for the user's left foot by dividing the user's left foot rotation angle by three.

Aspect 14: The method of Aspect 9, 10, 11, 12, or 13, wherein the method comprises the step of forming a marking on the bicycle shoe, the marking indicating the center of the cleat.

Aspect 15: The method of Aspect 9, 10, 11, 12, 13, or 14, wherein the method comprises the step of forming a marking on the bicycle shoe, the marking indicating the center of the back of the bicycle shoe.

Aspect 16: The method of Aspect 9, 10, 11, 12, 13, 14, or 15, wherein the step of rotating the body of the tool such that the angle measurement indicia indicate the predetermined cleat angle comprises rotating the body of the tool from a zero degree angle with a 0 degree indicia aligning with the marking indicating the center of the back of the bicycle shoe to a predetermined cleat angle wherein a predetermined cleat angle indicia of the predetermined cleat angle aligns with the marking indicating the center of the back of the bicycle shoe.

Furthermore, if any references have been made to patents and printed publications throughout this disclosure, each of these references and printed publications are individually incorporated herein by reference in their entirety.

While the present methods and devices have been specifically described with respect to use in fitting cycling cleats, and the specific configurations shown in particular for Look(R) and Shimano(R) cleats, it will be appreciated that other applications are possible and contemplated herein, including other brands and types of bicycle cleats, and cleats for shoes other than bicycle shoes. The various aspects described above, including elements of the various embodiments described above, can be combined to provide further embodiments. Various portions and components of apparatus within the scope of this disclosure, including for example, structural components, can be formed by one or more various suitable manufacturing processes known to those in the art. Similarly, various portions and components of apparatuses within the scope of this disclosure can be made from suitable materials known to those in the art.

The above description has set out various features, functions, methods, and other aspects of the disclosure. Time and further development may change the manner in which the various aspects are implemented. The scope of protection defined by the claims is not intended to be limited to the specific sizes, shapes, features, or other aspects of the disclosed embodiments. The claimed inventions may be implemented or embodied in other forms while still being within the scopes of the concepts disclosed hereby. Also included are equivalents of the elements of the claims that can be made without departing from the scopes of concepts properly protected by the claims that follow. The configurations disclosed herein are illustrative of the principles of the present disclosure, and other modifications that may be employed are within the scope of this disclosure. Thus, by way of example, but not of limitation, alternative configurations of the embodiments of the present disclosure may be utilized in accordance with the teachings herein. Accordingly, the present disclosure is not limited to the embodiments precisely as shown and described.

What is claimed:

1. A bicycle cleat-fitting tool system comprising:

a body having a superior face and an inferior face, a front portion and a back portion;

the body defining a cleat receptacle for receiving a cleat to be fitted, the cleat receptacle perpendicular to a medial line of the body;

the superior face of the body comprising a cleat retaining mechanism to selectively hold the cleat to be fitted within the cleat receptacle, the cleat retaining mechanism comprising an elongate lateral bar attached to the superior face of the body via a spring, the spring biasing the elongate lateral bar toward the front portion of the body, and the elongate lateral bar movable over the cleat receptacle to hold a cleat in place within the cleat receptacle; and the superior face of the body comprising angle measurement indicia to indicate a degree of rotation of the body and the cleat receptacle with respect to a bicycle shoe to be fitted with the cleat.

2. The bicycle cleat-fitting tool system of claim 1, wherein the body is formed of transparent material.

3. The bicycle cleat-fitting tool system of claim 2, the lateral bar further comprising an indicia at a middle of the lateral bar to be aligned with an indicia at a middle of the cleat.

4. The bicycle cleat-fitting tool system of claim 2, wherein the cleat receptacle extends from the superior face to the inferior face.

5. The bicycle cleat-fitting tool system of claim 1, wherein the front portion of the body further comprises angle measurement indicia.

6. A bicycle cleat-fitting tool system comprising:

a body having a superior face and an inferior face, a front portion and a back portion;

the body formed of transparent material, the body defining a void extending from the superior face to the inferior face, the void for receiving a cleat to be fitted, the void perpendicular to a medial line of the body extending from the front portion to the back portion of the body;

the superior face of the body comprising a cleat attachment mechanism, the cleat attachment mechanism comprising a lateral bar attached to the superior face of the tool via a spring, the spring biasing the lateral bar toward the front portion of the body, the lateral bar movable over the void to hold a cleat within the void in place within the void, and the lateral bar further comprising an indicia at a middle of the lateral bar; and the superior face of the body comprising angle measurement indicia to indicate a degree of rotation of the body with respect to a bicycle shoe to be fitted with the cleat.

7. The bicycle cleat-fitting tool system of claim 6, wherein the front portion of the body further comprises angle measurement indicia.

8. A method of fitting a cleat to a bicycle shoe, the method comprising:

selecting the bicycle cleat-fitting tool system of claim 1;

retracting the cleat retaining mechanism;

fitting the cleat within the cleat receptacle and securing the cleat with the cleat retaining mechanism;

aligning a center of the cleat receptacle with a marking indicating the center of the cleat; and rotating the body of the tool such that the angle measurement indicia indicate a predetermined cleat angle with respect to a marking indicating the center of a back of the bicycle shoe.

9. The method of claim 8, wherein the method further comprises the step of measuring a user's right foot rotation angle and the user's left foot rotation angle.

10. The method of claim 9, wherein the step of measuring the user's right foot rotation angle and the user's left foot rotation angle comprises instructing the user to place their right foot on one side of a straight line, and their left foot on the other side of the straight line, and further instruct the user to jump and/or walk forwards and backwards.

11. The method of claim 9, wherein the method further comprises determining a user's predetermined cleat angle for the user's right foot by dividing the user's right foot rotation angle by three, and determining a user's predetermined cleat angle for the user's left foot by dividing the user's left foot rotation angle by three.

12. The method of claim 8, wherein the method comprises the step of forming a marking on the bicycle shoe, the marking indicating the center of the cleat.

13. The method of claim 8, wherein the method comprises the step of forming a marking on the bicycle shoe, the marking indicating the center of the back of the bicycle shoe.

14. The method of claim 13, wherein the step of rotating the body of the tool such that the angle measurement indicia indicate the predetermined cleat angle comprises rotating the body of the tool from a zero degree angle with a 0 degree indicia aligning with the marking indicating the center of the back of the bicycle shoe to a predetermined cleat angle wherein a predetermined cleat angle indicia of the predetermined cleat angle aligns with the marking indicating the center of the back of the bicycle shoe.

15. A bicycle cleat alignment tool system comprising:

a body having a superior face and an inferior face, a front portion and a back portion;

the body defining a cleat receptacle for receiving a cleat to be aligned on a cycling shoe;

the superior face of the body comprising a cleat retaining mechanism to selectively hold the cleat to be aligned in place within the cleat receptacle, the cleat retaining mechanism comprising a lateral bar attached to the body via a spring, the spring biasing the lateral bar toward the front portion of the body, the lateral bar movable over the cleat receptacle to selectively hold a cleat within the cleat receptacle; and the superior face of the body comprising angle measurement indicia to indicate a degree of rotation of the body and the cleat receptacle with respect to the cycling shoe.

16. The bicycle cleat alignment tool system of claim 15, wherein the superior face of the body comprises angle measurement indicia to indicate a degree of rotation of the body with respect to a bicycle shoe to be fitted with the cleat.

17. The bicycle cleat alignment tool system of claim 15, the lateral bar further comprising an indicia at a middle of the lateral bar to be aligned with an indicia at a middle of the cleat.

* * * * *